United States Patent [19]

Shueh et al.

[11] 4,207,753

[45] Jun. 17, 1980

[54] DRAIN SYSTEM FOR HOUSEHOLD REFRIGERATOR

[75] Inventors: Samuel B. Shueh, San Jose, Calif.; Louis C. Williams, Louisville, Ky.

[73] Assignee: General Electric Company, Louisville, Ky.

[21] Appl. No.: 962,427

[22] Filed: Nov. 20, 1978

[51] Int. Cl.[2] ..... F25D 21/14

[52] U.S. Cl. ..... 62/285

[58] Field of Search ..... 62/285, 288

[56] References Cited

U.S. PATENT DOCUMENTS

| | | | |
|---|---|---|---|
| 2,720,089 | 10/1955 | Morton | 62/287 X |
| 2,755,636 | 7/1956 | Horvay | 62/287 |
| 2,867,095 | 1/1959 | Robbie | 62/285 |
| 3,334,494 | 8/1967 | McAllister | 62/287 |

*Primary Examiner*—Lloyd L. King
*Attorney, Agent, or Firm*—Frederick P. Weidner; Radford M. Reams

[57] ABSTRACT

A refrigerator having an outer case and an inner liner with insulation therebetween, the inner liner forming a fresh food storage compartment. An evaporator is disposed in the upper portion of the fresh food storage compartment. There is an elongate opening in the rear wall of the fresh food storage compartment and a drain trough is disposed on the interior surface of the rear wall below the evaporator and the elongate opening. A cover member is positioned in and covers the elongate opening, which cover member has a peripheral flange abutting the interior surface of the rear wall and a recess body portion extending through the elongate opening. There is provided a centrally located opening in the cover member and a trough on each side of the opening along the upper portion, both of which are arranged to underlie the exterior surface of the top wall of the inner liner. Both troughs are inclined downwardly to the centrally located opening whereby moisture condensed on the exterior surface of the top wall will collect in the trough and flow to the centrally located opening and therethrough to the drain trough on the interior of the rear wall.

11 Claims, 5 Drawing Figures

DRAIN SYSTEM FOR HOUSEHOLD REFRIGERATOR

BACKGROUND OF THE INVENTION

This invention relates to household refrigerators and, more particularly, to a drain system for a household refrigerator.

In a typical household refrigerator, commonly referred to as a top mount model, the freezing compartment is at the top of the cabinet and a fresh food compartment below the freezer compartment. The freezer compartment has an evaporator disposed in conjunction with the walls thereof to provide below freezing temperature to the freezer compartment. A portion ofthe evaporator passes through the walls of the fresh food compartment and is disposed within the fresh food compartment to provide cooling temperatures above the freezing point. During normal operation of the system, frost tends to collect on the evaporator and on the portions of the evaporator within the fresh food compartment requiring periodic removal of the frost layer for maximum efficiency of the system. When the frost layer is melted, the defrost water tends to flow downwardly along any incline surface of the evaporator and any surfaces in association with the evaporator. There is a tendency for such defrost water to flow along the surfaces between the freezer compartment and the fresh food compartment and into the insulation provided between the inner and outer walls of the cabinet. Since any water in the insulation decreases the insulating value thereof and prevents the refrigeration system from operating efficiently as well as causing possible corrosion of the cabinet which is made of sheet metal, it is desirable that a drain system be provided wherein any defrost water is directed away from the insulation and disposed of in a suitable manner.

Drain systems have in the past been devised to help dran the defrost water and such systems are generally disclosed in U.S. Pat. Nos. 2,755,636; 2,867,095 and 3,334,494, all of which are assigned to the assignee of the present invention.

By our invention, there is provided a drain system for refrigerators wherein defrost water or other condensation is directed away from the insulation between the inner and outer walls of the cabinet and disposed of in a suitable manner.

SUMMARY OF THE INVENTION

There is provided in a refrigerator having an outer case and an inner liner with insulation therebetween, the inner liner forming a fresh food storage compartment including a top wall having an interior surface and an exterior surface, rear wall, bottom wall, and side walls. An evaporator is disposed in the upper portion of the food storage compartment in close proximity to the top wall and is inclined toward the rear wall. There is an elongate opening in the rear wall and a drain trough is disposed on the interior surface of the rear wall below the evaporator and the elongate opening. A cover member is positioned in and covers the elongate opening, which cover member has a peripheral flange abutting the interior surface of the rear wall. The cover member also has a recess body portion extending from the interior surface through the elongate opening and has a centrally located opening and a trough on each side of the opening along its upper portion underlying the exterior surface of the top wall of the inner liner. Both troughs are inclined downwardly to the centrally located opening whereby moisture condensed on the exterior surface of the top wall will collect in the troughs and flow to the centrally located opening and therethrough to the drain trough on the interior of the rear wall.

By this drain system, defrost water or other condensate is directed away from the insulation between the outer case and the inner liner.

DESCRIPTION OF THE PREFERRED EMBODIMENT

Figure 1:
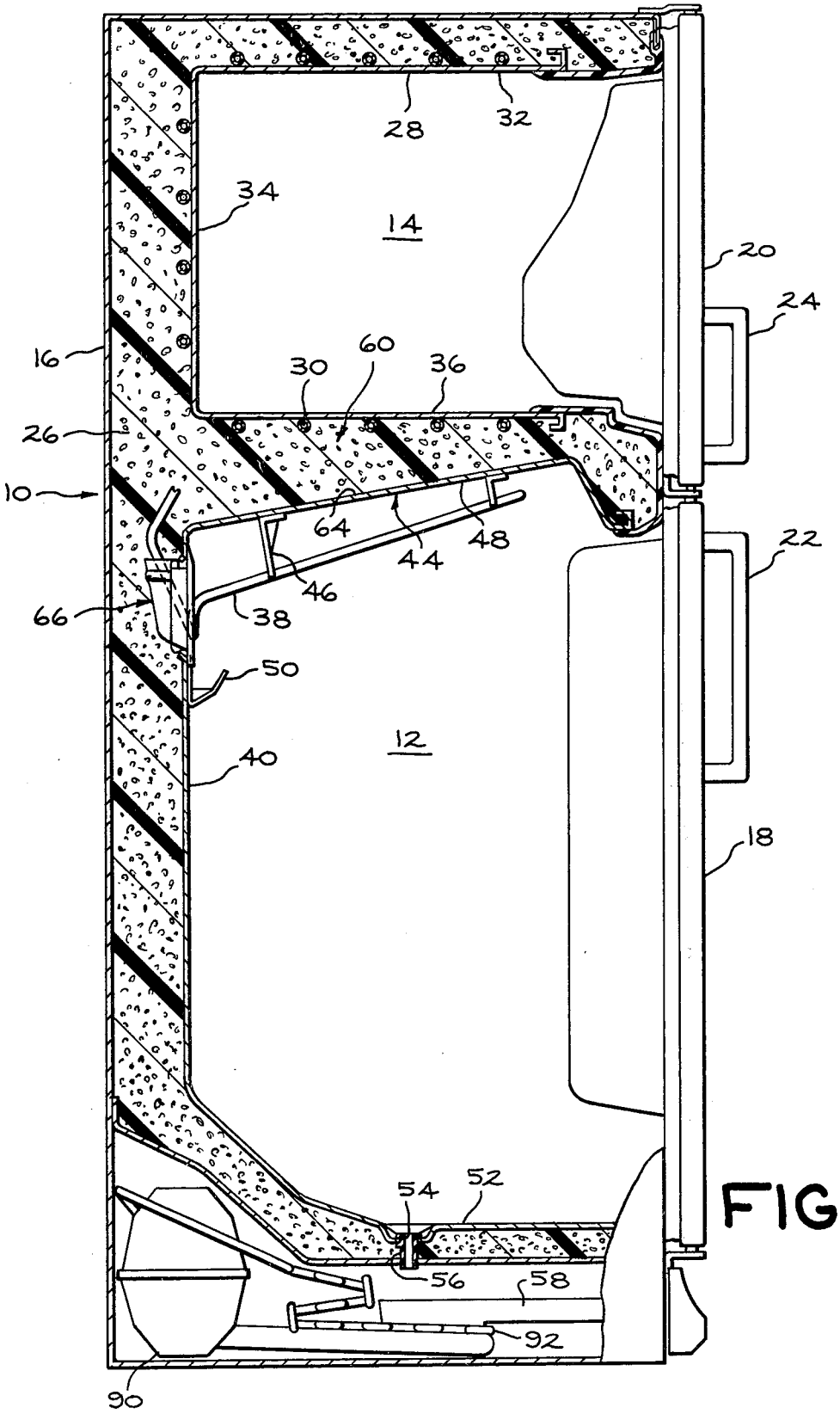
FIG. 1 is a side elevational view of a combination refrigerator freezer with parts broken away and others partly in cross section to show the interior of the fresh food and freezer compartments and embodying the present invention.
Figure 3:
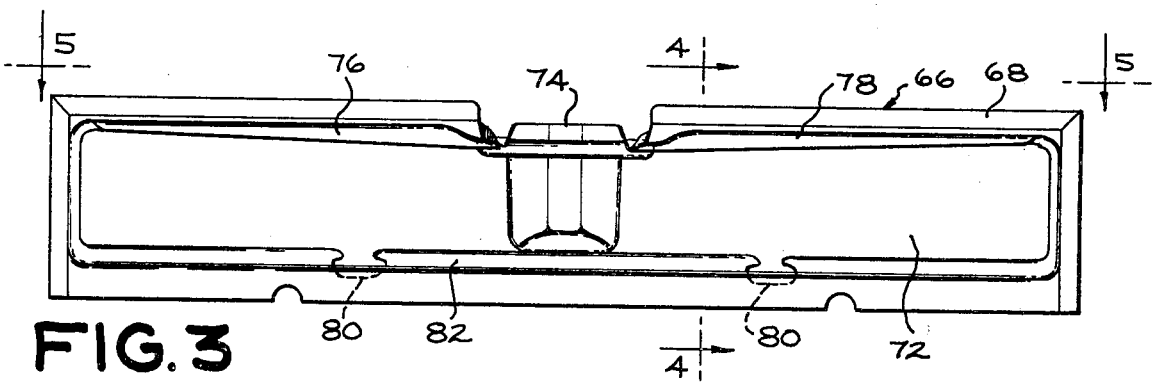
FIG. 3 is a front elevational view showing the cover member of the drain system of the present invention.
Figure 5:
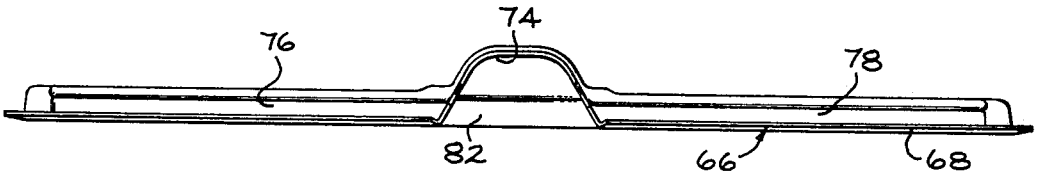
FIG. 5 is a top plan view of the cover member of the present invention taken along lines 5—5 of FIG. 3.

Referring to FIG. 1, there is shown a side view of a two-door combination refrigerator freezer 10 having a lower fresh food compartment 12 and an upper freezer compartment 14 supported within an outer refrigerator case 16. A side swinging door 18 is mounted on the front of the outer case and it is adapted to close the fresh food compartment 12. Another side swinging door 20 is mounted to the outer case 16 and is adapted to close the freezer compartment 14. The first door 18 has a door handle 22 while the second door 20 has a door handle 24. Cabinet thermal insulation material 26, examples of which are low density fiberglas, polyurethane, or the like surrounds both the fresh food compartment 12 and the freezer compartment 14 and generally fills the space between those compartments and the outer case 16.

The freezer compartment 14 is formed by a box-like liner 28 which is furnished with an evaporator coil 30 of serpentine shape that is fixed to the exterior surfaces of the liner 28 such as the top wall 32, the rear wall 34 and the bottom wall 36. The evaporator coil 30 provides for cooling the interior of the freezer compartment to below the freezing point.

Figure 2:
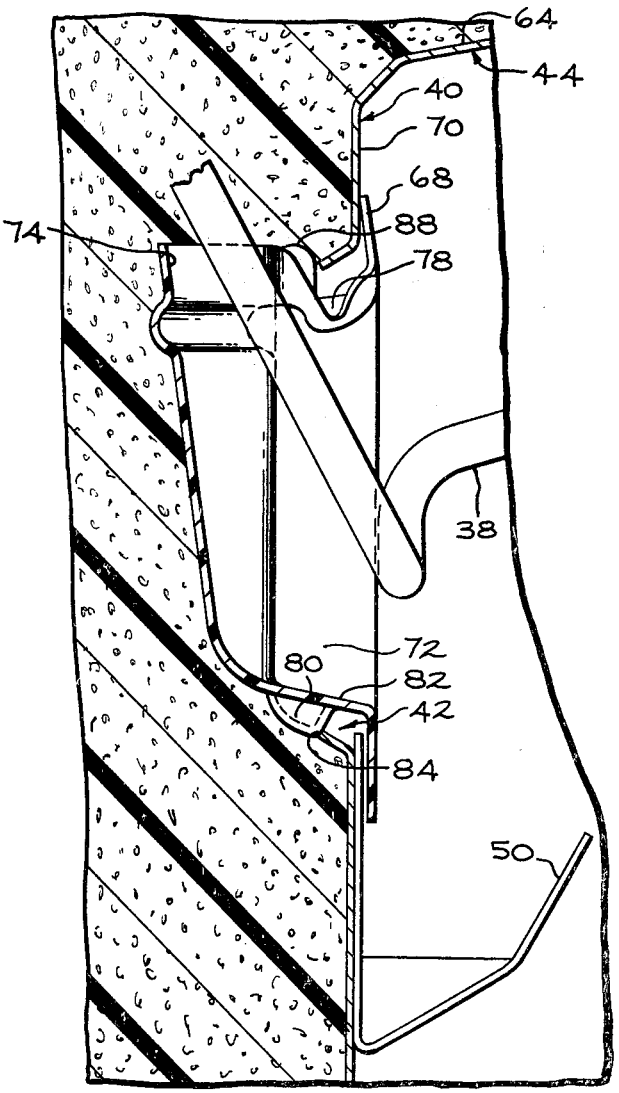
FIG. 2 is a sectional view showing the drain system of the present invention.
Figure 4:
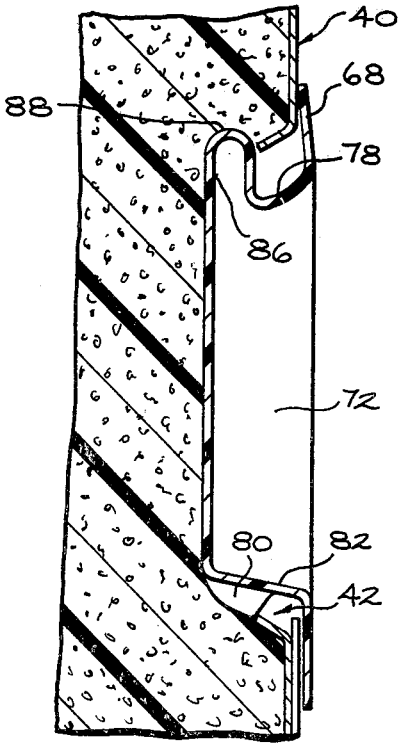
FIG. 4 is a sectional view showing the cover member of the present invention taken along lines 4—4 of FIG. 3.

The evaporator coil 30 has a portion 38 for the fresh food compartment 12 and is positioned within that compartment near the top portion thereof. The fresh food compartment 12 has a rear wall 40 with an opening 42 (FIG. 2) through which the portion 38 of the evaporator coil 30 passes. The fresh food compartment 12 has a top wall 44 which has fastened to it two brackets 46 which support the portion 38 of the evaporator coil 30 in its proper position. The portion 38 of the evaporator 30 will receive a coating of frost when moisture within the compartment 12 is deposited thereon and frozen. This frost occurs as moisture is precipitated from the air circulating within the fresh food compartment as the evaporator cools the air to a temperature below its dew point temperature. The temperature of this evaporator portion 38 is below the freezing point of water, and the moisture deposited on the evaporator surface freezes to form a frost formation, which frost is objectionable in this location because it acts as an insulator between the refrigerator evaporator and the air inside the cabinet. This evaporator portion 38 is defrosted automatically everytime the refrigerator compressor turns off. Melted frost water or condensate drains from the evaporator coil portion 38. Since the evaporator coil portion is in close proximity to the top wall 44, moisture will also collect on the interior surface 48 of the top wall 44. To provide drainage of the melted frost water and condensate on both the evaporator coil portion 38 and the interior surface 48 of top wall 44, they are inclined downwardly towards the rear wall 16 of the fresh food compartment. To collect the melted frost water or condensate, there is provided a trough 50 that is fastened to the rear wall 40 of the compartment 12. This water drains out the end of the trough and down the corner of the fresh food compartment to the bottom wall 52 to a drain opening grommet 54 provided through the bottom wall water trap 52. The water flows through the opening 54 and through a drain tube 56 into an underlying pan 58 located near the floor.

Frost also builds up on both the interior and exterior surfaces of the liner of the freezer compartment 14. This frost is not melted when the compressor cycles off because of the low operating temperature of the freezer evaporator 30. Hence, the freezer compartment has a manual defrost cycle which must be initiated by the user.

One of the problems in drain systems for refrigerators having a freezer compartment at the top of the cabinet and separated from the fresh food compartment by a partition generally shown in FIG. 1 as 60 is that during the defrost, water has a tendency to collect on the exterior surface 64 of the top wall 44 of the fresh food compartment. Since, as indicated previously, it is desirable that the top wall 44 be inclined downwardly toward the rear wall 16 of the fresh food compartment, the defrost water or other condensate flows by gravity toward the rear of the refrigerator. To prevent this water from collecting between the inner liner and outer case of the refrigerator and causing the thermal insulation material 26 to become wet, there must be a positive drainage system provided to direct the water away from the insulation. There will now be described the structural arrangement to provide for such a drain system.

An elongate opening 42 (FIG. 2) in the rear wall 40 of the fresh food compartment 12 is provided and is generally of rectangular shape. The opening 42 is provided near the top of the fresh food compartment between the top wall 44 and the trough 50. A cover member 66 is positioned in and covers the elongate opening 42. The cover member 66 has a peripheral flange 68 which abuts the interior surface 70 of the rear wall 40 and is dimensioned larger than the elongate opening 42. There is a recess body portion 72 dimensioned slightly smaller than the elongate opening 42 extending from the interior surface 70 of the rear wall 40 through the elongate opening. The recessed body portion 72 has a centrally located opening 74 through which the evaporator portion 38 of the evaporator coil 30 may pass through the rear wall 40 into the interior of the fresh food compartment 12. There is provided in the cover member 66 on both sides of the centrally located opening 74 troughs 76 and 78, both of which are inclined from the respective ends of the cover member toward the centrally located opening 74 so that water may, by gravity, drain toward the centrally located opening 74. The troughs 76 and 78 are arranged to underlie the exterior surface 64 of the top wall 44 of the fresh food compartment. By this arrangement, moisture condensed on the exterior surface 64 will drain rearwardly and downwardly into the troughs 76 and 78 whereupon it will flow to the centrally located opening 74 and through that opening to the drain trough 50 on the interior surface of the rear wall 40. From there, the water will drain into the pan 58 near the floor as described above.

The cover member 66 is provided with lugs 80 formed on the lower edge 82 of the recessed body portion 72 and they are spaced from the peripheral flange 68. The peripheral flange 68 and the lugs 80 cooperate to receive in the space therebetween the lower edge 84 of the elongate opening 42 and provide for retention of the cover member in the elongate opening.

The upper portion 86 of the recessed body 72 is formed to provide the troughs 76 and 78 which are formed between the peripheral flange 68 and a ridge portion 88 spaced from and parallel to the peripheral flange 68. The ridge portion 88 aids in retaining the cover member in the elongate opening 42 in cooperation with the peripheral flange 68 at the top of the elongate opening by receiving the rear wall 40 at the top of the elongate opening 42 in the space therebetween. Thus, by the cooperation between the ridge portion 88 at the top of the cover member and the lugs 80 at the bottom thereof in association with the peripheral flange 68, the cover member is retained in the elongate opening 42 without the need of further securement means. The cover member 66 may be made of any suitable material and in the preferred embodiment that material would be flexible and preferably it would be made of flexible plastic. In this manner, the cover member is easily formed and readily positioned and secured in the elongate opening as described above.

It will be understood that by this drain system defrost water or condensate will drain rearwardly and such water on the interior of the fresh food compartment will drain into the interior trough 50 while any water on the exterior of the top wall of the fresh food compartment will drain into the troughs 76 and 78 and flow to the centrally located opening 74 and therethrough into the interior of the fresh food compartment and downwardly into the trough 50. From trough 50 the water will be drained downwardly into an underlying pan 58. The refrigerator system includes a compressor 90 and a condenser 92. Because of the close proximity of the condenser 92 to the pan 58, heat from the condenser 92 will evaporate any water collected in the pan 58 and thus dispose of it in a suitable manner.

The foregoing is a description of preferred embodiment of the invention and it should be understood that variations may be made thereto without departing from the true spirit of the invention as defined in the appended claims.

What is claimed is:

1. In a refrigerator having an outer case and an inner liner with insulation therebetween, the inner liner forming a fresh food storage compartment including a top wall having an interior surface and an exterior surface, rear wall, bottom wall, and side walls comprising:

(a) an evaporator disposed in the upper portion of said food storage compartment in close proximity to the top wall and inclined toward the rear wall, (b) an elongate opening in the rear wall, (c) a drain trough disposed on the interior surface of the rear wall below the evaporator and elongate opening, (d) a cover member positioned in and covering the elongate opening, said cover member having (i) a peripheral flange abutting the interior surface of the rear wall, (ii) a recess body portion extending from the interior surface through the elongate opening, said recess body portion having a centrally located opening and a trough on each side of the opening along its upper portion underlying the exterior surface of the top wall of the inner liner, both troughs being inclined downwardly to the centrally located opening, whereby water on the exterior surface of the top wall will collect in the troughs and flow to the centrally located opening and therethrough to the drain trough on the interior of the rear wall.

2. The refrigerator of claim 1 wherein the cover member has lugs formed on the lower edge of the recessed body portion and spaced from the flange and the rear wall at the bottom of the elongate opening is received in the space to provide retention of the cover member in the elongate opening

3. The refrigerator of claim 1 wherein the upper portion of the recessed body portion of the cover member is formed to provide the troughs between the periperal flange and a ridge portion spaced from and parallel to the flange.

4. The refrigerator of claim 3 wherein the space between the ridge portion and peripheral flange receives the rear wall of the top of the elongate opening to provide retention of the cover member in the elongate opening in cooperation with the lugs formed in the lower edge of the recessed body portion.

5. The refrigerator of claim 1 wherein a portion of the evaporator passes from the exterior to the interior of the food storage compartment and is positioned in the centrally located opening of the recessed body portion.

6. The refrigerator of claim 1 wherein the cover is made of flexible material.

7. The refrigerator of claim 6 wherein the flexible material is plastic.

8. The refrigerator of claim 1 wherein the drain trough on the interior of the rear wall is inclined to one corner of the food storage compartment.

9. The refrigerator of claim 8 wherein the bottom wall of the food storage compartment has a drain opening and the water collected in the drain trough on the interior of the rear wall flows to the corner of the food storage compartment and down the interior of the rear wall through the drain opening into a pan below the bottom wall.

10. The refrigerator of claim 1 wherein the top wall of the food storage compartment is inclined downwardly toward the rear wall thereof.

11. The refrigerator of claim 10 wherein the evaporator is secured to the top wall of the food storage compartment.

* * * * *